US010881226B1

(12) United States Patent
Ou

(10) Patent No.: US 10,881,226 B1
(45) Date of Patent: Jan. 5, 2021

(54) ADJUSTABLE PILLOW

(71) Applicant: SHENZHEN YOUMIOU TECHNOLOGY CO., LTD, Shenzhen (CN)

(72) Inventor: Jixiang Ou, Ganzhou (CN)

(73) Assignee: SHENZHEN YOUMIOU TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/838,000

(22) Filed: Apr. 1, 2020

(30) Foreign Application Priority Data

Mar. 11, 2020 (CN) ..... 2020 2 0291172 U

(51) Int. Cl.
*A47G 9/10* (2006.01)

(52) U.S. Cl.
CPC ..... *A47G 9/10* (2013.01); *A47G 9/109* (2013.01); *A47G 9/1054* (2013.01); *A47G 9/1063* (2013.01); *A47G 9/1072* (2013.01); *A47G 9/1081* (2013.01); *A47G 2009/1018* (2013.01)

(58) Field of Classification Search
CPC ..... A47G 9/10; A47G 9/1054; A47G 9/1063; A47G 9/1072; A47G 9/1081; A47G 9/109; A47G 2009/1018
See application file for complete search history.

(56) References Cited

U.S. PATENT DOCUMENTS 4,916,765 A * 4/1990 Castronovo, Jr. .... A47G 9/1081 297/284.1
5,533,218 A * 7/1996 Fahy ..... A47C 27/144 5/421
6,789,282 B1 * 9/2004 Frydman ..... A47C 20/021 5/630
6,823,546 B1 * 11/2004 Hsu ..... A47G 9/007 5/636
7,013,512 B1 * 3/2006 Hsu ..... A47G 9/1081 5/636
7,594,288 B1 * 9/2009 Holliday ..... A47G 9/10 5/636
2005/0150051 A1 * 7/2005 Greenawalt ..... A47G 9/10 5/636
2011/0252567 A1 * 10/2011 Yu ..... A47G 9/10 5/640
2013/0263377 A1 * 10/2013 Wootten, Jr. ..... A47C 27/15 5/640
2013/0326816 A1 * 12/2013 Wu ..... A47G 9/109 5/640
2014/0196214 A1 * 7/2014 DuPre ..... A47G 9/0253 5/644
2015/0089743 A1 * 4/2015 Haworth ..... A47G 9/1036 5/640

* cited by examiner

*Primary Examiner* — Robert G Santos
*Assistant Examiner* — Rahib T Zaman

(57) ABSTRACT

The present disclosure provides an adjustable pillow. The adjustable pillow includes a main body and a replaceable pillow module. A groove is arranged on a middle of the main body. A shape of the groove matches with a shape of the replaceable pillow module. And the replaceable pillow module is arranged in the groove. The replaceable pillow module is able to be made of different materials and/or the replaceable pillow module is able to have different thicknesses.

6 Claims, 3 Drawing Sheets

ADJUSTABLE PILLOW

TECHNICAL FIELD

The present disclosure relates to a field of medical device, and in particular to an adjustable pillow.

BACKGROUND

Pillows are an important tool for people when they sleep or lie down. Conventional pillows are a one-piece structure. Different people choose pillows of different materials and thickness according to their needs. For a same person, he/she also likes to choose pillows with different thicknesses at different stages.

Since the thickness of the pillow is fixed during production, if the person likes to change the pillow height frequently, or if it is not suited for people's different needs (e.g., a hotel), he/she will need to buy multiple pillows, which increases costs and causes waste of storage space.

SUMMARY

The present disclosure provides an adjustable pillow to solve problems in the prior art.

The adjustable pillow of the present disclosure includes a main body and a replaceable pillow module. A groove is arranged on a middle of the main body. A shape of the groove matches with a shape of the replaceable pillow module. And the replaceable pillow module is arranged in the groove. The replaceable pillow module is replaceable with different material and different thicknesses.

Furthermore, the main body includes a head supporting region and a transition region. The groove extends from the head supporting region to the transition region.

Furthermore, a width of the groove on the transition region is grew than a width of the groove on the head supporting region.

Furthermore, the replaceable pillow module includes a hook structure arranged on a tail portion of the replaceable pillow module.

Furthermore, a transition surface is arranged between a top surface of the hook structure and a top surface of the replaceable pillow module.

Furthermore, a bottom surface of the replaceable pillow module includes a first quick connector arranged on a bottom face of the replaceable pillow module, and a second quick connector arranged on a bottom surface of the groove.

Furthermore, the first quick connector and the second quick connector are touch fasteners.

By providing the groove on the main body of the adjustable pillow and the replaceable pillow matching with the groove, the replaceable pillow module is able to be replaced according to different users or the same user's different habits. Thus, the replaceable pillow module is able to be made of different materials and/or the replaceable pillow module is able to have different thicknesses. Therefore, users are able to adjust a softness of the adjustable pillow by replacing the replaceable pillow module made of different materials, and the users are able to adjust a thickness of the adjustable pillow by replacing the replaceable pillow module with different thickness, which makes the adjustable pillow to meet the various requirements of customers.

DETAILED DESCRIPTION

In order to make the technical means, creative features, achievement goals and effects achieved by the present disclosure easy to understand, the present disclosure will be further described below in conjunction with specific embodiments. It should be understood that the specific embodiments described herein are only used to explain the present disclosure and are not intended to limit the present disclosure.

By providing a groove on a main body of an adjustable pillow and a replaceable pillow matching with the groove, the replaceable pillow module is able to be replaced according to different users or the same user's different habits. Thus, the replaceable pillow module is able to be made of different materials and/or the replaceable pillow module is able to have different thicknesses. Therefore, users are able to adjust softness of the adjustable pillow by replacing the replaceable pillow module made of different materials, and the users are able to adjust a thickness of the adjustable pillow by replacing the replaceable pillow module with different thickness, which makes the adjustable pillow to meet the various requirements of customers.

Embodiment 1

Figure 1:
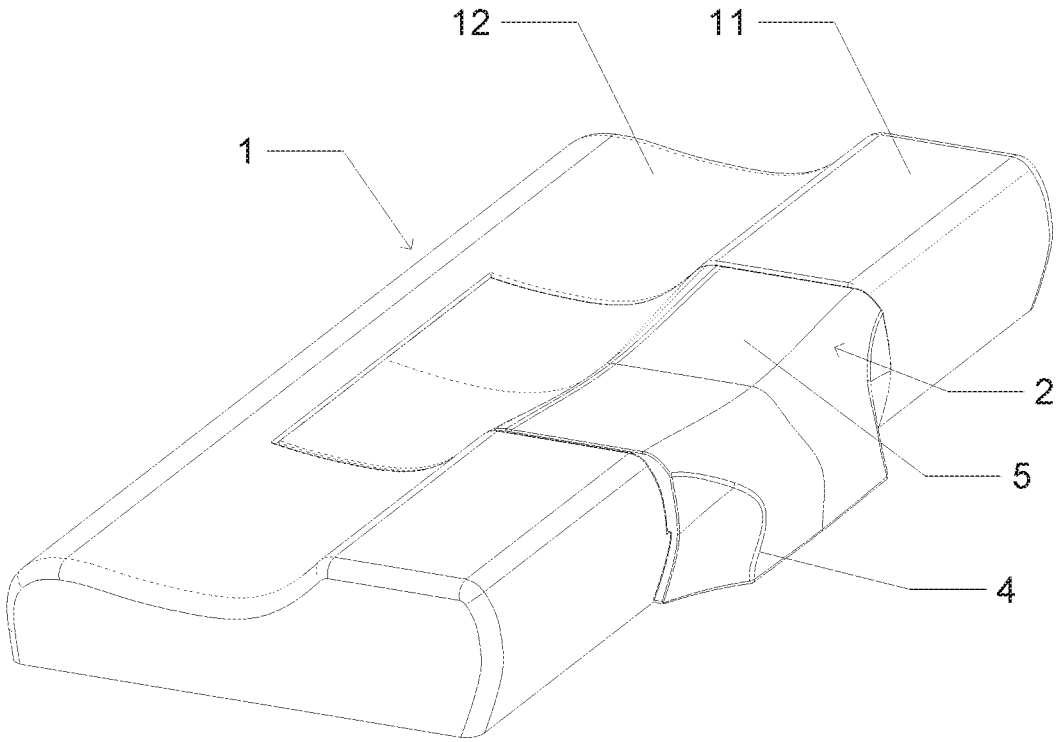
FIG. 1 is a schematic diagram showing a structure of an adjustable pillow of the present disclosure.
Figure 2:
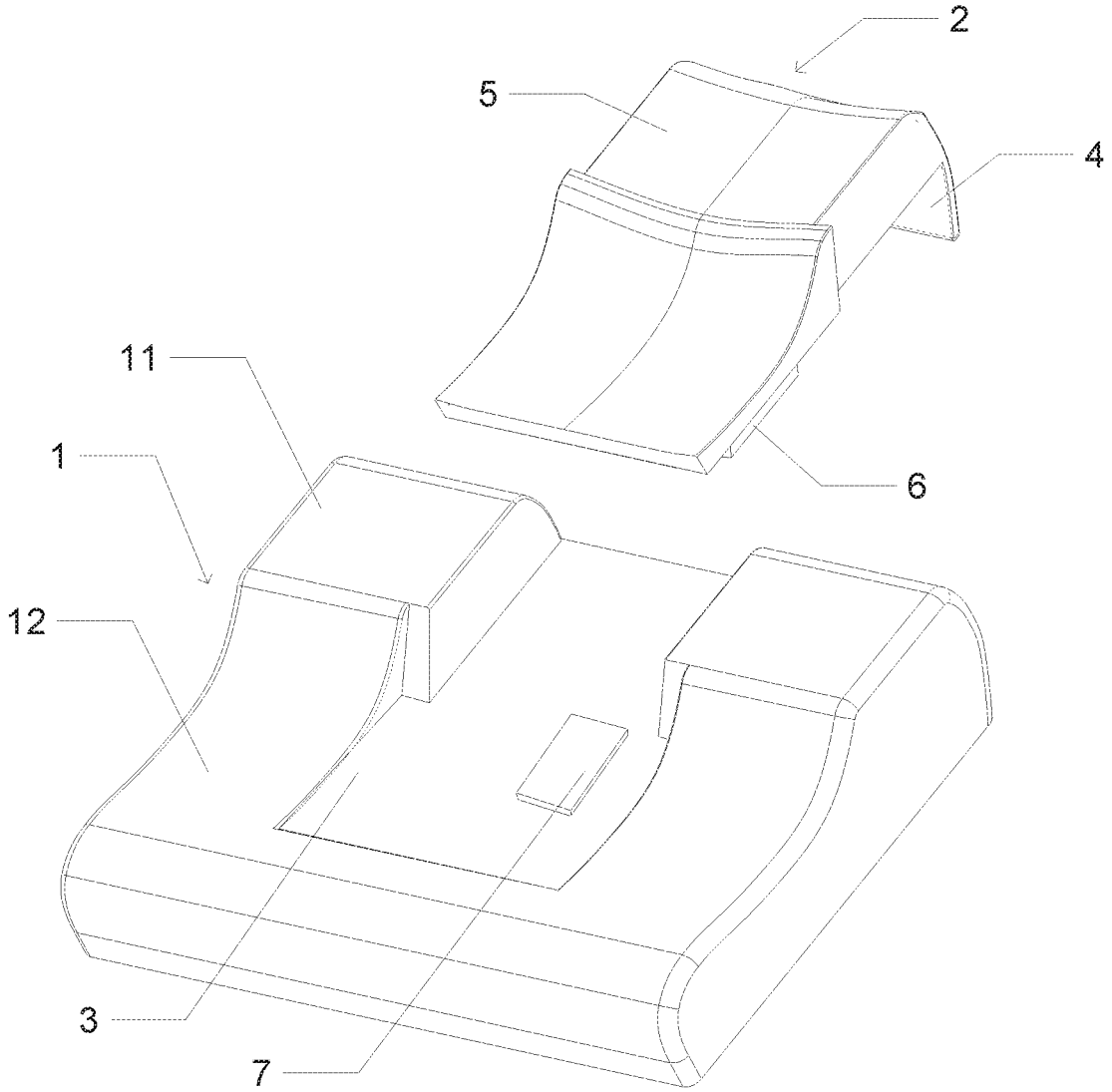
FIG. 2 is an exploded schematic diagram showing the structure of the adjustable pillow of the present disclosure.

As shown in FIGS. 1-2, the present disclosure provides an adjustable pillow. The adjustable pillow includes a main body 1 and a replaceable pillow module 2. A groove 3 is arranged on a middle of the main body 1. A shape of the groove 3 matches with a shape of the replaceable pillow module 2. And the replaceable pillow module 2 is arranged in the groove 3; wherein the replaceable pillow module 2 is able to be made of different materials and/or the replaceable pillow module 2 is able to have different thicknesses.

The main body 1 provides great support for head with sufficient width. Due to the groove 3 being arranged on the middle of the main body 1, the replaceable pillow module 2 can be replaced easily. The shape of the replaceable pillow module 2 matches with the shape of the groove 3 and is arranged in the groove 3, which makes better convenience and effect after replacing the replaceable pillow module 2. Meanwhile, because the replaceable pillow module 2 is able to be made of different materials and/or the replaceable pillow module 2 is able to have different thicknesses, users are able to adjust a softness of the adjustable pillow by replacing the replaceable pillow module 2 made of different materials, and the users are able to adjust a thickness of the adjustable pillow by replacing the replaceable pillow module 2 with different thickness, which makes the adjustable pillow to meet the various requirements of customers.

In the embodiment, by providing the groove 3 on the main body 1 of the adjustable pillow and the replaceable pillow module 2 matching with the groove 3, the replaceable pillow module 2 is able to be replaced according to different users or the same user's different habits. Thus, the replaceable pillow module 2 is able to be made of different materials and/or the replaceable pillow module 2 is able to have different thicknesses. Therefore, users are able to adjust a softness of the adjustable pillow by replacing the replaceable pillow module 2 made of different materials, and the users are able to adjust a thickness of the adjustable pillow by replacing the replaceable pillow module 2 with different thickness, which makes the adjustable pillow to meet the various requirements of customers.

As shown in FIGS. 1-2, in the embodiment, the main body 1 includes a head supporting region 11 and a transition region 12. The groove 3 extends from the head supporting region 11 to the transition region 12. The head supporting region 11 supports a user's head. The transition region 11 is a transition for the user's head to lie on. By extending the groove 3 from the head supporting region 11 to the transition region 12, the groove 3 is arranged at a great location which makes the replaceable pillow module 2 arranged in the groove 3 easily.

Figure 3:
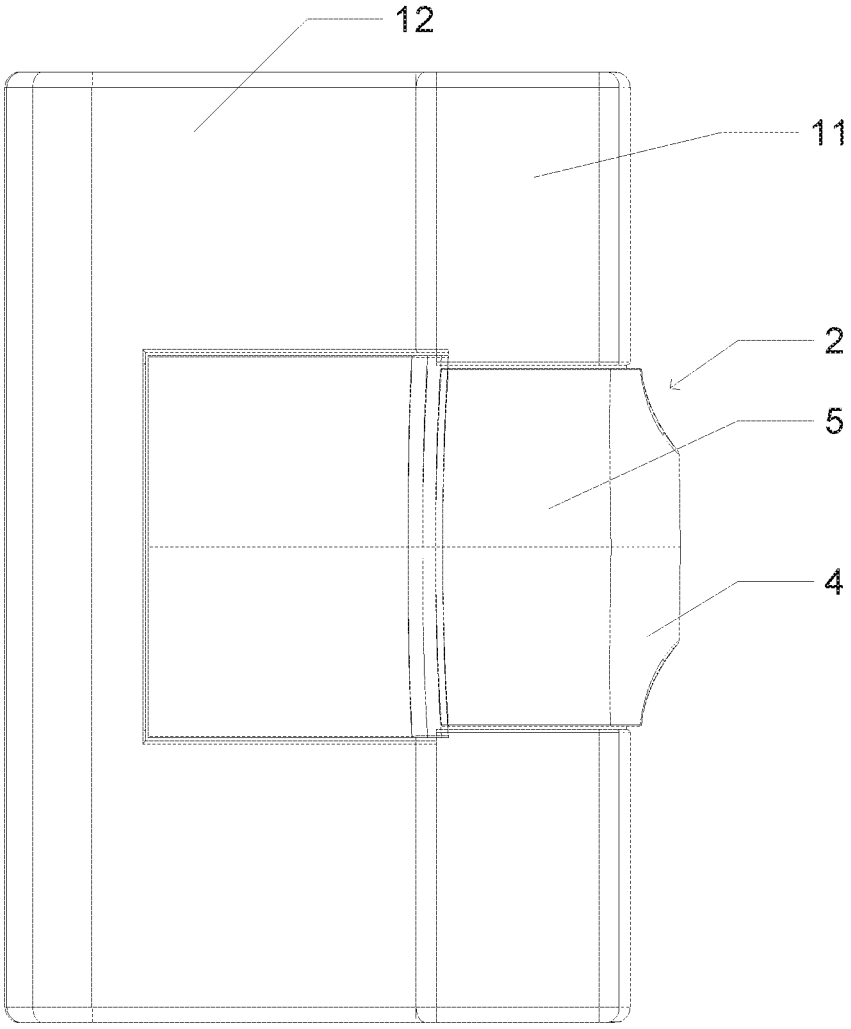
FIG. 3 is a top view of the adjustable pillow of the present disclosure.

As shown in FIGS. 2-3, in the embodiment, a width of the groove 3 on the transition region 12 is greater than a width of the groove 3 on the head supporting region 11. Because the replaceable pillow module 2 matches with the groove 3, by providing the width of the groove 3 on the transition region 12 greater than the width of the groove 3 on the head supporting region 11, a stair of the groove 3 is formed at a joint between the transition region 12 and the head supporting region 11. The stair of the groove 3 jams the replaceable pillow module 2 when the replaceable pillow module 2 is arranged in the groove 3, which limits the position of the replaceable pillow module 2 and avoids displacement of the replaceable pillow module 2 during head movements when sleeping to improve user experience.

As shown in FIGS. 1-2, in the embodiment, the replaceable pillow module 2 includes a hook structure 4 arranged on a tail portion of the replaceable pillow module 2. By providing the hook structure 4 arranged on the tail portion of the replaceable pillow module 2, the movement of the replaceable pillow module 2 is effectively limited. At the same time, the hook structure 4 is limited by a one side of the main body 1 so that the replaceable pillow module 2 is engaged with the groove 3 and a height of both sides of the replaceable pillow module 2 is on a same level of a height of a top surface of the main body 1, which makes the overall pillow beautiful and comfortable.

As shown in FIGS. 1-2, in the embodiment, a transition surface 5 is arranged between a top surface of the hook structure 4 and a top surface of the replaceable pillow module 2. The transition surface 5 provided on the pillow surface effectively perform a transition effect of the head, so that the experience effect of the adjustable pillow is good, and is widely used.

As shown in FIG. 2, in the embodiment, the replaceable pillow module 2 includes a first quick connector 6 arranged on a bottom face of the replaceable pillow module 2, and a second quick connector 7 arranged on a bottom surface of the groove 3. The replaceable pillow module 2 can be securely fixed on the main body 1 by the connection between the first quick connector 6 and the second quick connector 7, which prevents the replaceable pillow module 2 from falling off from the groove 3 and has high security. Meanwhile, the connection between the first quick connector 6 and the second quick connector 7 provides stationary between the main body 1 and the replaceable pillow module 2 for high assembly efficiency and better convenience.

As shown in FIG. 2, the first quick connector 6 and the second quick connector 7 are touch fasteners. The use of the touch fasteners for installation and fixing has low cost and good flexibility, which not only improve comfort while being convenient for fixing, but also is convenient for generalizing and using.

The above are only some optional embodiments of the present disclosure, and are not intended to limit the present disclosure. Any modification, equivalent replacement, and improvement made within the spirit and principles of the present disclosure shall be within the scope of the present disclosure.

What is claimed is:

1. An adjustable pillow, comprising a main body and a replaceable pillow module; wherein a groove is arranged on a middle of the main body; a shape of the groove matches with a shape of the replaceable pillow module; and the replaceable pillow module is arranged in the groove;

wherein the replaceable pillow module is replaceable with different materials and different thicknesses;

wherein the replaceable pillow module comprises a hook structure arranged on a tail portion of the replaceable pillow module.

2. The adjustable pillow according to claim 1, wherein the main body comprises a head supporting region and a transition region, and wherein the groove extends from the head supporting region to the transition region.

3. The adjustable pillow according to claim 2, wherein a width of the groove on the transition region is greater than a width of the groove on the head supporting region.

4. The adjustable pillow according to claim 1, wherein a transition surface is arranged between a top surface of the hook structure and a top surface of the replaceable pillow module.

5. The adjustable pillow according to claim 1, wherein a bottom surface of the replaceable pillow module comprises a first quick connector arranged on a bottom face of the replaceable pillow module, and a second quick connector arranged on a bottom surface of the groove.

6. The adjustable pillow according to claim 5, wherein the first quick connector and the second quick connector are touch fasteners.

* * * * *